US006488571B2

(12) United States Patent
Sharan

(10) Patent No.: US 6,488,571 B2
(45) Date of Patent: Dec. 3, 2002

(54) APPARATUS FOR ENHANCED RATE CHEMICAL MECHANICAL POLISHING WITH ADJUSTABLE SELECTIVITY

(75) Inventor: Sujit Sharan, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/746,470

(22) Filed: Dec. 22, 2000

(65) Prior Publication Data

US 2002/0081950 A1 Jun. 27, 2002

(51) Int. Cl.[7] ..... B24B 1/00
(52) U.S. Cl. ..... 451/53; 451/7

(58) Field of Search ..... 451/7, 36, 53, 451/285, 286, 287, 288, 41; 438/692, 693

(56) References Cited

U.S. PATENT DOCUMENTS 5,873,769 A * 2/1999 Chiou et al. ..... 451/7
6,077,783 A * 6/2000 Allman et al. ..... 438/691
6,121,144 A * 9/2000 Marcyk et al. ..... 438/692

* cited by examiner

*Primary Examiner*—George Nguyen
*Assistant Examiner*—Dung Van Nguyen
(74) *Attorney, Agent, or Firm*—Mark V. Seeley

(57) ABSTRACT

A chemical mechanical polishing apparatus is described, which includes a platen, a polishing pad that is attached to the platen, and a means for adjusting the temperature of the polishing pad.

4 Claims, 2 Drawing Sheets

APPARATUS FOR ENHANCED RATE CHEMICAL MECHANICAL POLISHING WITH ADJUSTABLE SELECTIVITY

FIELD OF THE INVENTION

The present invention relates to chemical mechanical polishing apparatus, which may be used to make semiconductor devices.

BACKGROUND OF THE INVENTION

To make a semiconductor device, several layers of different types of material are deposited on a substrate, e.g., a silicon wafer. After they are deposited, those layers are processed to create devices and interconnects that form the desired integrated circuits. Many of those layers must be planarized to ensure that subsequently deposited layers will be applied to a substantially flat surface. A widely adopted planarizing technique is chemical mechanical polishing ("CMP").

FIG. 1*a* illustrates a cross-section of a structure that may be formed when making a semiconductor device. That structure includes conductive layer 100 upon which is formed dielectric layer 101. Barrier layer 102 lines a via that has been etched into dielectric layer 101, and copper layer 103 is formed on barrier layer 102. A CMP step is applied to that structure to remove copper layer 103, and the underlying barrier layer, from the surface of dielectric layer 101—generating the structure shown in FIG. 1*b*.

Current methods for controlling the CMP process rely on modifying slurry composition and polishing pad properties. Changes to the slurry composition and/or the polishing pad may not, however, enable the polish rate, or the selectivity of that rate across different layers, to be optimized. Taking the example illustrated in FIGS. 1*a* and 1*b*, to produce the structure shown in FIG. 1*b* requires polishing through copper layer 103, then through barrier layer 102. Because copper is a relatively soft metal, it will polish at a relatively high rate, when compared to the rate at which barrier layer 102 (typically made from a relatively hard material like tantalum or tantalum nitride) is polished. When continuing to polish the structure after breaking through copper layer 103 to barrier layer 102, differences in selectivity of the polishing process to those two layers can cause significant dishing of wide features.

Such differences in selectivity may be a significant concern, when making damascene based structures. To make such structures, low selectivity between the primary metal (e.g., copper) and the underlying barrier layer (e.g., tantalum or tantalum nitride) is required; whereas, high selectivity must be maintained between those materials and the underlying dielectric layer to stop the CMP process on that layer. Optimally, the relative selectivity of the polishing process to the primary metal and the barrier layer is about 1:1; whereas, the relative selectivity to those materials, when compared to the dielectric layer, is about 100:1, or greater. Maintaining such a high degree of selectivity between the primary metal/barrier layer and the dielectric layer may be difficult, when such a layer is formed from polymer based, carbon based or porous low k dielectrics, as such materials are not as strong as silicon dioxide.

Accordingly, there is a need for an improved CMP apparatus that enables better control of the polishing rate and the selectivity of the polish rate across different layers. There is a need for such an apparatus that enables higher throughput for the CMP process. The present invention provides such an apparatus.

DETAILED DESCRIPTION OF THE PRESENT INVENTION

The present invention relates to an improved chemical mechanical polishing apparatus. That device includes a platen, a polishing pad that is attached to the. platen, and means for adjusting the temperature of the polishing pad. In the following description, a number of details are set forth to provide a thorough understanding of the present invention. It will be apparent to those skilled in the art, however, that the invention may be practiced in many ways other than those expressly described here. The invention is thus not limited by the specific details disclosed below.

Figure 2:
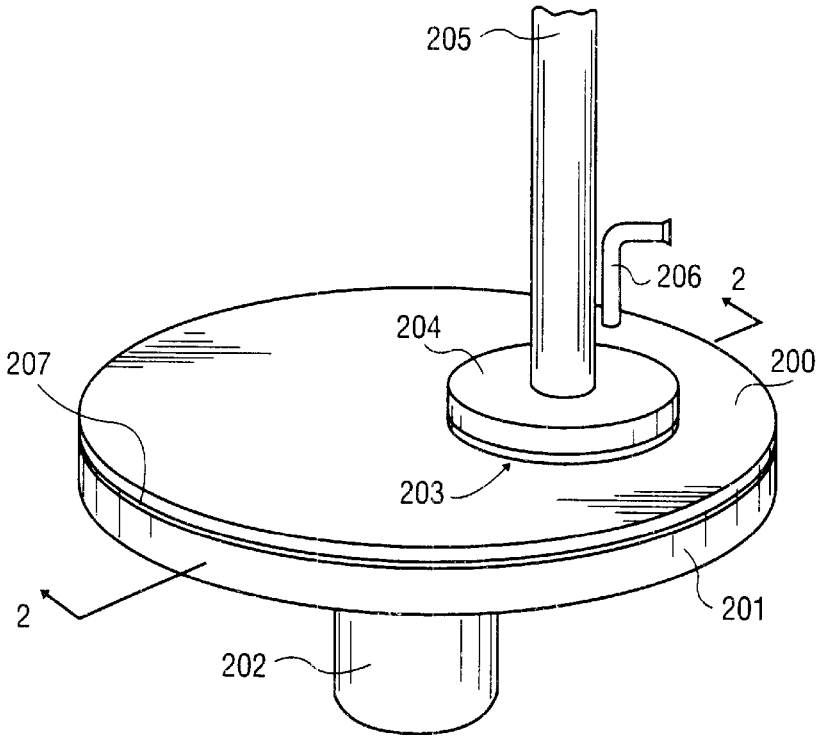
FIG. 2 is a perspective view of an embodiment of the CMP apparatus of the present invention.

FIG. 2 provides a perspective view of an embodiment of the CMP apparatus of the present invention. In that device, polishing pad 200.is attached to platen 201. Platen 201 may be rotated by rotating shaft 202, upon which platen 201 is fixed. A substrate 203, such as a silicon wafer, is mounted to substrate carrier 204, which may be rotated through shaft 205. Substrate 203 may be held in carrier 204 by friction or by vacuum. A pad (not shown) may be inserted between carrier 204 and substrate 203 to provide a cushion between the substrate and the carrier. The surface of substrate 203, which is to be polished, faces polishing pad 200 and is pressed against polishing pad 200 as platen 201 rotates.

A polishing slurry may be deposited on polishing pad 200. Such a slurry may initiate the polishing process by chemically reacting with the layer being polished. That slurry may be fed through tube 206 onto the surface of polishing pad 200. Alternatively, the slurry may be deposited onto that pad by forcing it upward through the pad.

Each of the features described above may be implemented with conventional components that are used to make CMP devices. In addition to those features, however, the CMP apparatus of the present invention includes heating element 207, which may be coupled to (or integrated into) polishing pad 200. Heating element 207 enables the polishing pad temperature to be varied as substrate 203 is polished. That capability adds another variable for controlling the polishing process.

Figure 3:
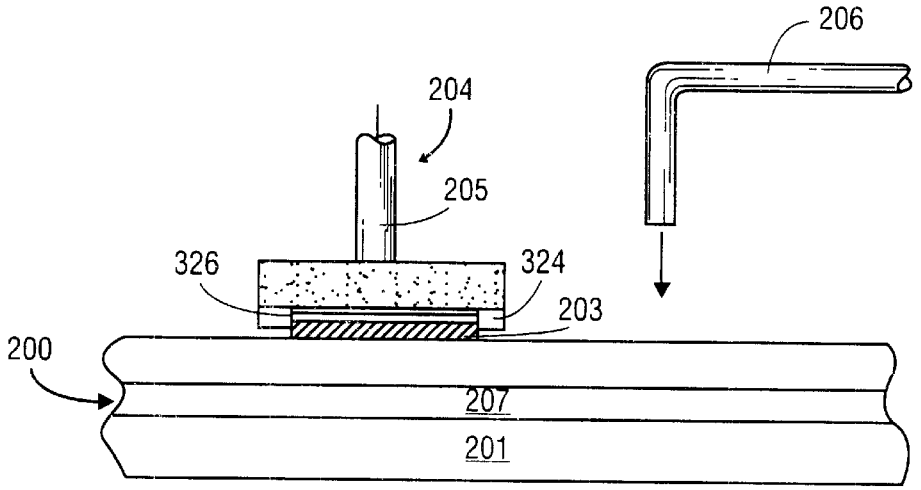
FIG. 3 is a cross-sectional view of the embodiment shown in FIG. 2, as taken along line 2—2 of FIG. 2.

FIG. 3 is a cross-sectional view of the embodiment shown in FIG. 2, as taken along line 2—2 of FIG. 2. Substrate 203 is placed face down on polishing pad 200, which is attached to rotatable platen 201. Carrier 204 is used to press substrate 203 against polishing pad 200, while a slurry is deposited onto polishing pad 200 from nozzle 206 during polishing. Shaft 205 may be used to apply a downward force and to rotate substrate 203. Retaining ring 324 prevents substrate 203 from slipping laterally during polishing and pad 326 provides a cushion between wafer 203 and carrier 204.

Integrated into polishing pad 200 is heating element 207. Heating element 207 may comprise an electrically resistive plate, or other component (e.g., a coil or mesh), that may be used to vary the temperature of the polishing pad. Heating element 207 may be coupled to a power source using wires or cables (not shown.) Although the embodiment shown in FIGS. 2 and 3 uses an electrically resistive heating element to vary the temperature of polishing pad 200, other means may be used to perform that function. For example, a lamp module may be integrated into the CMP apparatus of the present invention for that purpose. Such a module may comprise a single lamp positioned above polishing pad 200, or alternatively, a ring configuration that includes several lamps that are spaced along the perimeter of the pad. In other embodiments, the temperature of polishing pad 200 may be varied through convection. In those embodiments, a reservoir that contains a gas or liquid may be positioned around the perimeter of pad 200. In such an apparatus, the pad temperature may be varied by heating or cooling that gas or liquid.

In embodiments of the present invention that include an under pad between the polishing pad and the platen, a heating element may be integrated into the under pad instead of the polishing pad. Those skilled in the art will recognize that components other than those described above may be added to the CMP apparatus to vary the temperature of the polishing pad and/or the surface of the substrate held by the substrate carrier. In that respect, any CMP apparatus that provides for such a temperature varying function falls within the spirit and scope of the present invention.

The polish rate may be correlated with temperature, i.e., the rate may increase with increasing temperature and decrease with decreasing temperature. Because the CMP apparatus of the present invention can vary the temperature of the polishing pad, it can be used to tailor the polishing rate and/or selectivity of that rate across different layers. In addition, varying the temperature at which the substrate is polished may control the relative degree to which chemical processes and mechanical abrasion remove material from the substrate.

Figure 1A:
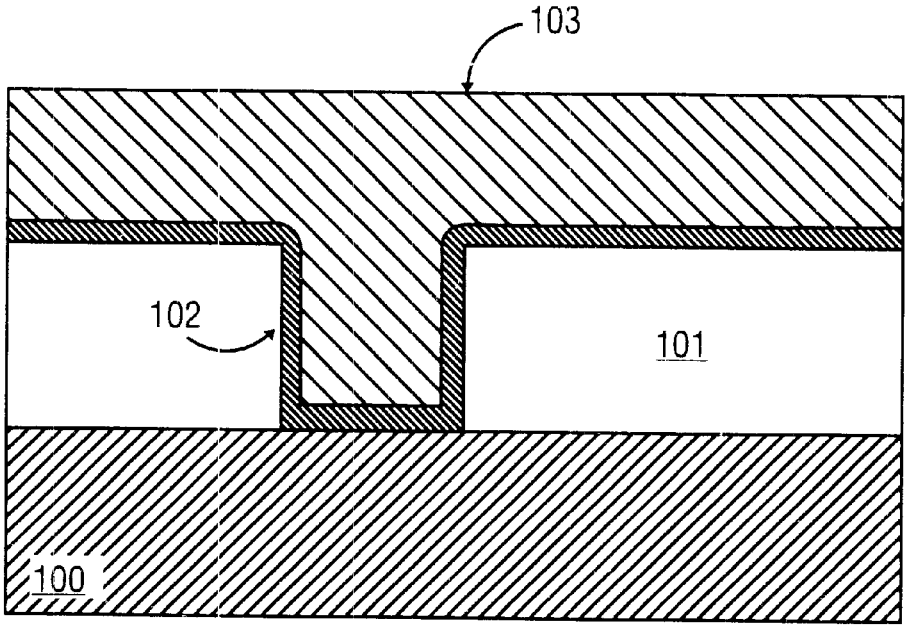
Figure 1a (Prior Art)
FIGS. 1*a* and 1*b* illustrate cross-sections of structures that may be formed when making a semiconductor device.
Figure 1B:
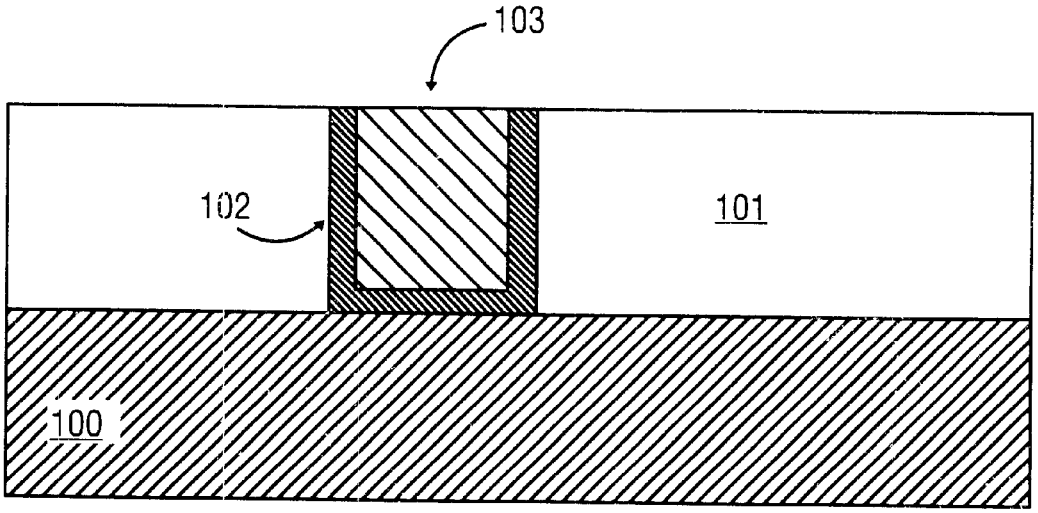
Figure 1b (Prior Art)

Returning to the FIGS. 1*a*/1*b* example, a first layer (e.g., copper layer 103) may be polished while maintaining its temperature within a first temperature range, and a second layer (e.g., barrier layer 102) may be polished while maintaining its temperature within a second temperature range. When the first layer comprises copper and the second layer comprising tantalum, tantalum nitride, or a tantalum/tantalum nitride composite, that first temperature range may be 25° C. to 50° C. while the second temperature range may be 150° C. to 200° C. If that second layer is made from a different type of barrier material, e.g., titanium nitride or tungsten nitride, the optimum polishing pad temperature may fall within, or slightly outside of, the temperature range specified here.

By increasing the temperature, after copper layer 103 has been removed, the polishing rate for barrier layer 102 can be increased. As a result, the selectivity of the polish rate between the copper layer and the barrier layer may be substantially reduced, when compared to the selectivity that applies when those layers are polished at the same temperature. Because increasing the temperature increases the polishing rate, the same slurry can be used to polish both the copper layer and the barrier layer while reducing differences in the selectivity of the polishing rate to those layers. Optimally, temperatures are selected for polishing those layers that cause the selectivity to be close to 1:1.

When the barrier layer removal step is almost complete, the temperature may be reduced to decrease the rate at which the remainder of that layer is removed, making it easier to stop the polishing process at dielectric layer 101. Such a practice may be particularly useful when dielectric layer 101 comprises a polymer based, carbon based or porous low k insulating material.

The CMP apparatus of the present invention may be used in many other contexts. It may be used to polish various types of metal layers (including those made from materials other than copper), various types of barrier layers (including those made from materials other than the ones mentioned above), and various types of insulating layers. This apparatus may, in essence, be used to polish any of the wide variety of materials that are used to form layers that must be planarized, when making a semiconductor device. This apparatus may be used to increase the rate at which such materials are removed—even when polishing silicon dioxide or another insulating material. Alternatively, when it is desirable to reduce that polishing rate, or increase selectivity, this apparatus may be used to decrease the polishing rate. A chamber that contains a coolant may, for example, supply a means for lowering the polishing pad temperature to decrease the polishing rate.

The CMP apparatus of the present invention thus enables polishing rates and selectivity to be adjusted in a relatively simple and controllable way for any type of material to which a CMP process may be applied. That, in turn, should afford better control and higher throughput of CMP processing. By providing another means for controlling polishing performance—in addition to slurry and polishing pad composition—the CMP apparatus of the present invention should render the CMP process more robust.

Features shown in the above figures are not intended to be drawn to scale, nor are they intended to be shown in precise positional relationship. Additional components that may be used to make the CMP apparatus of the present invention have been omitted when not useful to describe aspects of the present invention. Although the foregoing description has specified certain features that may be included in such an apparatus, those skilled in the art will appreciate that many modifications and substitutions may be made. Accordingly, it is intended that all such modifications, alterations, substitutions and additions be considered to fall within the spirit and scope of the invention as defined by the appended claims.

What is claimed is:

1. A method of polishing a surface of a substrate for making a semiconductor device comprising:

polishing a first layer while maintaining the first layer's temperature within a first temperature range;

changing the temperature of a polishing pad that is used to polish the first layer from a first temperature that is within the first temperature range to a second temperature that is within a second temperature range; and polishing a second layer while maintaining the second layer's temperature within the second temperature range.

2. The method of claim 1 wherein the first layer comprises copper and the second layer comprises a barrier layer.

3. The method of claim 2 wherein the first temperature range is 25° C. to 50° C., the barrier layer comprises a material selected from the group consisting of titanium nitride, tantalum nitride, tungsten nitride, and tantalum, and the second temperature range is 150° C. to 200° C.

4. The method of claim 1 wherein changing the temperature of the polishing pad reduces differences in the polishing process' selectivity to the first and second layers.

* * * * *